US009009977B2

(12) United States Patent
Kahtani et al.

(10) Patent No.: US 9,009,977 B2
(45) Date of Patent: Apr. 21, 2015

(54) GEOGRID SAND FENCE

(75) Inventors: Nasser S Kahtani, Agrabiyah Khobar (SA); Jonathan J Grosch, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 1064 days.

(21) Appl. No.: 12/274,206

(22) Filed: Nov. 19, 2008

(65) Prior Publication Data

US 2010/0123112 A1 May 20, 2010

(51) Int. Cl.
*B21D 47/00* (2006.01)
*E01F 7/02* (2006.01)

(52) U.S. Cl.
CPC ..... *E01F 7/02* (2013.01)

(58) Field of Classification Search
USPC ..... 256/12.5, 1–73; 29/897.3
See application file for complete search history.

(56) References Cited

U.S. PATENT DOCUMENTS

| | | | | |
|---|---|---|---|---|
| 2,753,156 | A * | 7/1956 | Rieger | 256/12.5 |
| 2,872,161 | A * | 2/1959 | Olson | 256/24 |
| 3,347,527 | A * | 10/1967 | Andrews | 256/12.5 |
| 3,913,889 | A * | 10/1975 | Nugent et al. | 256/12.5 |
| 4,339,114 | A | 7/1982 | Deike | |
| 4,339,117 | A * | 7/1982 | Tison | 269/289 MR |
| 5,184,800 | A * | 2/1993 | Tabler | 256/12.5 |
| 5,267,816 | A * | 12/1993 | Mercer et al. | 405/302.7 |
| 5,269,631 | A * | 12/1993 | Mercer et al. | 405/302.7 |
| 5,402,988 | A | 4/1995 | Eisele | |
| 5,419,659 | A | 5/1995 | Mercer | |
| 5,669,796 | A * | 9/1997 | Harford | 442/220 |
| 5,758,868 | A | 6/1998 | Shea | |
| 5,864,427 | A * | 1/1999 | Fukano et al. | 359/492 |
| 6,626,611 | B2 | 9/2003 | Winters | |
| 6,890,367 | B2 * | 5/2005 | Alghamdi | 55/406 |
| 6,986,624 | B1 * | 1/2006 | Tabler | 405/302.7 |
| 7,001,112 | B2 | 2/2006 | Walsh | |
| 7,011,112 | B2 | 3/2006 | Chszaniecki | |
| 7,780,148 | B2 * | 8/2010 | Kirby | 256/12.5 |

(Continued)

FOREIGN PATENT DOCUMENTS

| | | | |
|---|---|---|---|
| CN | 1580418 | A | 8/2003 |
| DE | 8620556 | U1 | 11/1996 |

(Continued)

OTHER PUBLICATIONS

Alghamdi, Al-Kahtani, Sand Control Measures and Sand Drift Fences, Nov. 2005, Journal of Performance of Constructed Facilities, 295-299.*

(Continued)

*Primary Examiner* — Jacob Cigna
(74) *Attorney, Agent, or Firm* — Bracewell & Guiliani LLP; Constance Gall Rhebergen

(57) ABSTRACT

A geogrid sand fence for depositing matter moved by wind currents and related methods, are provided. A geogrid sand fence for the control of sand or other particulate matter movement can include support members carrying a fencing material. The fencing material can include a High Density Polyethylene geogrid mesh material having apertures distributed to provide approximately a 50% porosity to maximize sand deposit volume. The geogrid mesh material has sufficient structural weight to be employed with a height of approximately two meters, which can be adjusted to maintain maximum effectiveness.

17 Claims, 6 Drawing Sheets

(56) References Cited

U.S. PATENT DOCUMENTS

| | | | | |
|---|---|---|---|---|
| 2001/0052595 | A1 | 12/2001 | Hulett | |
| 2006/0002772 | A1 * | 1/2006 | Tabler | 405/302.7 |
| 2006/0249720 | A1 | 11/2006 | Kirby | |
| 2007/0170411 | A1 * | 7/2007 | Ribak | 256/32 |

FOREIGN PATENT DOCUMENTS

| | | | |
|---|---|---|---|
| DE | 29821883 | U1 | 12/1997 |
| EP | 1038654 | A | 8/2001 |

OTHER PUBLICATIONS

AgriFlex Product Page, Snow Fence, <http://web.archive.org/20061207180409/http://www.agriflex-fencing.com/sno__fenc . . . > Archive.org dated Dec. 2006.*

Memphisnet.net, Netting, Plastic Fences. Archived from archive.org on Oct. 12, 2008, 2 pages. <http://www.memphisnet.net/category/netting__plastic__fences>.*

AgriFlex, "Snow Fence", <http://www.agriflex-fencing.com/snow__fence.html> ret Jan. 2014. www.archive.org date: Nov. 18, 2002.*

Memphis, "Plastic and Vinyl Coated Wire Netting", <http://www.memphisnet.net/10/FishCatalog/PlasticNetting.html? ret Jan. 2014. www.archive.org date Dec. 18, 2002.*

Tabler, "Snow Fence Guide" SHRP-W/FR-91-106, Strategic National Highway Research Program, National Research Counci, Published Oct. 1991. ISBN: 309-05251-3.*

Tabler, 1994 "Design Guidelines for the Control of Blowing and Drifting Snow", p. 199.*

Bofah, 1986 "Field tests of porous fences in the regime of sand-laden wind", Abstract. Journal of Wind Engineering and Industiral Aerodynamics.*

Tabler, 1992 "What's New in Fencing for Snow, Wind and Sand", 8 pages.*

Clements, 1963 "A Study of Windborne Sand and Dust in Desert Areas", p. 30, US Army Natick Laboratories, "Unclassified".*

PCT International Search Report and Written Opinion mailed Mar. 15, 2010.

* cited by examiner

Fig. 5
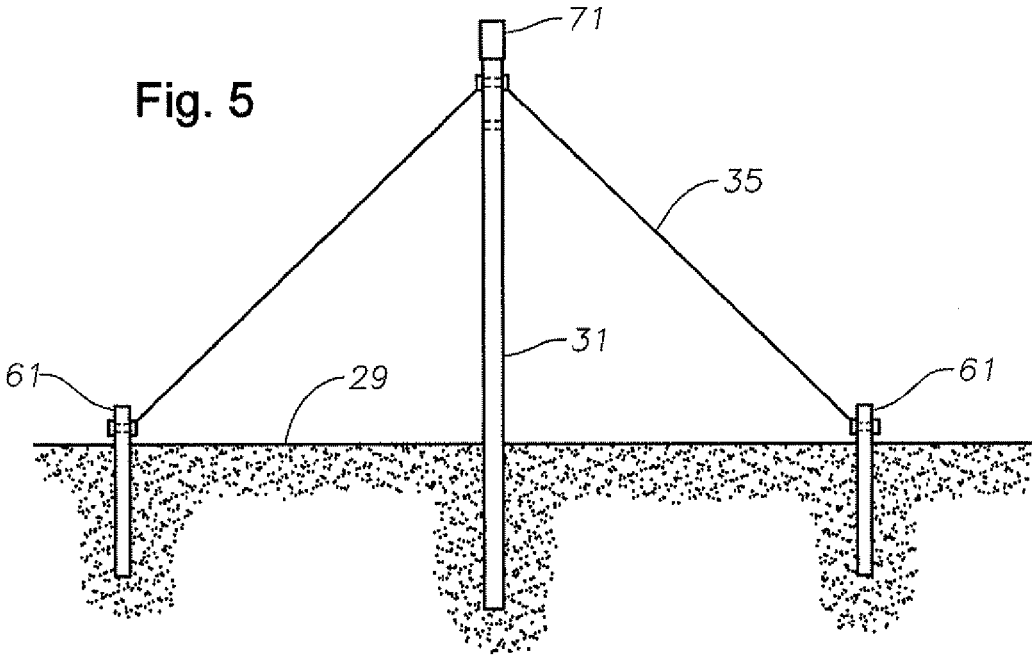
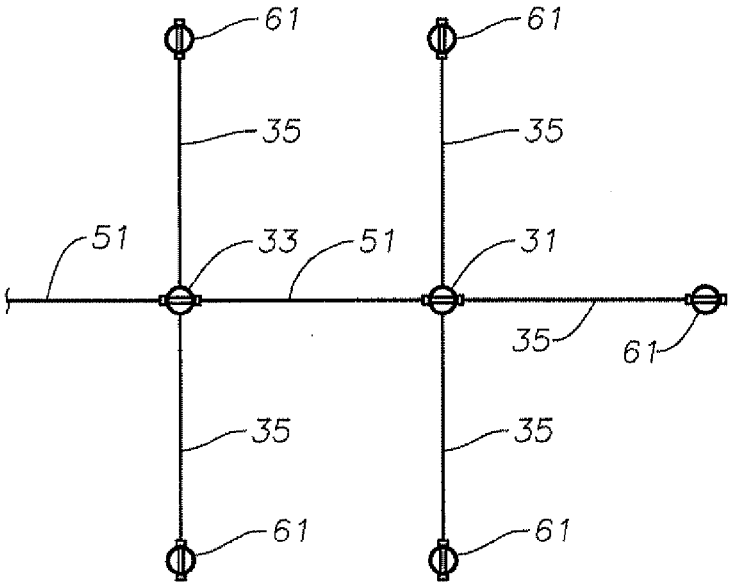
Fig. 6
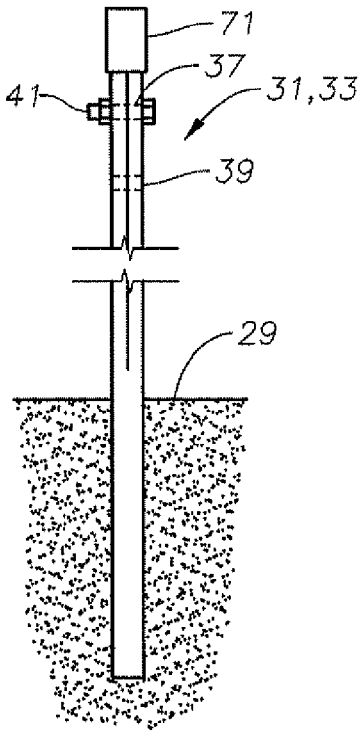
Fig. 7

GEOGRID SAND FENCE

BACKGROUND

1. Field of Invention

This invention relates in general to particle movement control and, in particular, to a fence for precipitating, depositing, and accumulating matter moved by wind currents to protect roads and facilities from sand encroachment.

2. Description of Related Art

Control of particulate matter, such as sand, is a major concern in many areas of the world. Over one-third of Saudi Arabia, for example, is covered by sand, which has hundreds of sand storms, annually. Facilities, wellsites and roads located in these desert areas suffer from sand accumulation caused by these movements. Over time, sand dunes and sand sheets accumulate, requiring costly excavation procedures.

There are a number of solutions employed to try to prevent such sand accumulation. These solutions include, for example, oil and chemical stabilization, vegetation, barrier fences, and wood slat or fabric sand fences. The concept of a "sand fence" is to reduce the wind speed as it passes through the fence, thereby causing the wind to deposit the sand load around the fence. This is in contrast to other types of fences, such as barrier-type fences, which are typically used to form a barrier to prevent sand or soil migration. The wood slat and fabric "sand fences" are placed at a distance from the facility to be protected, and the deposited sand accumulates at the fence location, thus reducing the amount of sand reaching the facility.

There are a number of disadvantages to the currently used methods. Oil and chemical stabilization will only hold the sand underneath the surface and will not stop it from traveling over the top of the surface. Vegetation typically requires at least two years to become permanently established, requires irrigation, and may be eaten by desert animals. Barrier-type fences, by their nature, quickly become buried, thus rendering them ineffective. Wood slat and fabric "sand fences" are not durable, are susceptible to damage and theft, and are very hard to repair. Further, due to structural and environmental limitations, the wood slat and fabric "sand fences" generally have a maximum height of approximately one meter, and cannot be extended in height. Accordingly, although not as quickly as barrier-type fences, the wood slat and fabric "sand fences" are, nevertheless, often relatively quickly buried by the sand over time, thus rendering them ineffective. This results in a requirement to either excavate the sand or install a replacement "sand fence." Further, although studies conducted by the inventors revealed that sand moved by wind currents that is subject to being accumulated through use of a sand fence, only extends from between the zero level and about the two meter level, as noted above, such conventional "sand fences" extend only up to approximately one meter, and thus, allow a great deal of sand to be moved, unimpeded, over the top of the conventional "sand fence." Additionally, the wood needed to build the wood slat "sand fences" often must be imported, or is not otherwise locally available.

Accordingly, recognized by the inventors is a need for a higher, more durable sand fence, configured to maximize both fence service life and sand accumulation volume, that is easy to manufacture, transport, and install, that has low maintenance requirements and is easy to repair, that has material specifications and construction procedures that are easy to standardize, and that does not require extensive material importation.

SUMMARY OF INVENTION

In view of the foregoing, embodiments of the present invention provide a sand fence/apparatus and methods to control sand or other particulate matter movement, to protect roads and other facilities from such encroachment. Embodiments of the present invention provide a sand fence made of an ultraviolet light resistant High Density Polyethylene geogrid mesh polymer material, which is durable, easy to repair, and easy to standardize, and which can be positioned to minimize the safety hazards and costs associated with mechanical sand excavation procedures. The polymer material, according to various embodiments of the present invention, has a plurality of apertures therein sized, shaped, and distributed to provide a porosity, for example, of approximately 50%, which was found through testing to maximize sand deposit volume and distribution. A 50% porosity and circular opening, for example, was found to provide gentle slowing down of wind velocity so that sand load carried by the wind will drop on the leeward of the sand fence.

According to various embodiments of the present invention, the height of the sand fence can also be substantially taller than conventional sand fences to maximize control of sand movement, which can be adjusted in response to sand accumulation in order to further and continuously maximize control of sand movement. According to embodiments of the present invention, the combination of porosity, aperture shape, height, structural weight, and structural composition of the sand fence can beneficially provide a sand fence having optimal sand movement control and accumulation, particularly on the leeward side of the fence.

Specifically, a sand fence for depositing sand particles moved by wind currents, according to an embodiment of the present invention, can include a plurality of support members to secure the sand fence to a surface. The plurality of support members can be positioned to extend downward into the surface a first preselected distance, and positioned to extend upwardly from the surface a second preselected distance. The plurality of support members can include at least two end post members and at least two, but typically a multitude of, intermediate post members. A set of four or so tensioning wires can extend between each pair of adjacent intermediate post members to enhance strength and stability. The sand fence can also include a fencing material attached to the plurality of support members and/or tensioning wires. The fencing material can include a flexible high density polyethylene geogrid mesh having a porosity in a range of between approximately 40% and 60% (e.g., 50%) and having a plurality of e.g., circular, apertures each having a diameter in the range of between, for example, approximately 6 mm and 10 mm, and positioned so that the sand fence gently reduces a speed of the wind currents as the wind currents move through the fencing material such that sand accumulation on a leeward side of the sand fence is substantially optimized. The High Density Polyethylene geogrid mesh can include approximately 2% finely divided carbon black, for example, to enhance the durability of the material. In order to help prevent buildup on the windward side of the sand fence, the fencing material can be suspended above the surface in a range of between approximately 10 cm and 20 cm, for example.

According to another embodiment of the present invention, a sand fence for depositing sand particles moved by wind currents can include a fencing material including a flexible polymer having a height of approximately 2 meters and having a plurality of apertures sized and distributed so that the flexible polymer has a porosity of approximately 50% to reduce a speed of the wind currents as the wind currents move through the fencing material. The combination of porosity and height of the flexible polymer advantageously can result in the optimization of sand particle accumulation on a leeward side of the sand fence. The apertures are preferably circular, with diameters in the range of approximately 6 mm to 10 mm. The flexible polymer can include a High Density Polyethylene geogrid mesh to provide sufficient strength and durability.

Embodiments of the present invention also include methods of depositing matter moved by wind currents. A method, for example, can include the step of securing a plurality of support members to a surface at a preselected offset distance from a facility to be protected. This step can include positioning the plurality of support members to extend downward into the surface a first preselected distance and extend upwardly from the surface a second preselected distance. The method can also include the steps of connecting a set of at least three, but preferably four, tensioning wires between adjacent pairs of support members, and attaching a polymer fencing material to the plurality of support members to thereby form a fence. The polymer fencing material has a height in a range of between approximately 1.5 meters to 2.5 meters (e.g. 2.0 meters) and has a plurality of apertures that result in a fencing material porosity in a range of between 40% to 60%, and more preferably between approximately 45% to 55%, to reduce a speed of the wind currents as the wind currents move through the fencing material, to thereby control between approximately 80% and 90% of moving particulate matter moving responsive to the wind currents, and thus, maximizing particulate matter precipitation and accumulation on a leeward side of the fence prior to the wind currents reaching the facility to be protected. The method can include the step of adjusting a height of the fence so that the height is increased responsive to particulate matter accumulation to thereby maintain maximized particulate matter accumulation. This step can include the steps of connecting a separate one of a plurality of extension members to an extension connector positioned at an upper end portion of each separate one of the plurality of support members, connecting a set of at least two tensioning wires between adjacent pairs of extension members, and attaching additional polymer fencing material to the plurality of extension members. The height of the fence can be adjusted, for example, when the particulate matter accumulated on the leeward side of the fence accumulates to a level of between approximately ⅓ to ⅔ meters from a top of the attached fencing material.

Advantageously, embodiments of the sand fence include a geogrid mesh of 50% porosity and circular apertures, which can be manufactured in long rolls of 80 to 100 meters long and 2 meters high. This mesh can be mounted on fence posts and tension wires to provide stability. The 50% porosity, in conjunction with circular apertures, was found in a study conducted by the inventors to be the most effective configuration in reducing the wind speed when it approaches the sand fence and in causing the drop of a maximum load of sand on the leeward side. Also from the study, it was determined that substantially higher porosities resulted in substantially less effect on wind speed, thus allowing more sand to pass the fence without stopping; and substantially lower porosities resulted in an excess deceleration or a sudden stop of wind velocity and the dropping the sand load in front of the sand fence, which results in shortening the life of the sand fence (i.e., the sand fence becoming quickly buried).

Also from the study, it was determined that the maximum height of the majority of sand particles carried by wind currents (80-90% of moving sand) was approximately 2 meters. The remainder of the sand (dust) was found in the study to be and remain in suspension regardless of the speed of the wind currents, and thus, was not economically efficient to try to control. Accordingly, embodiments of the present invention provide a geogrid sand fence having an effective height of approximately 2 meters. The study also concluded that perpendicular positioning of sand fence results in more sand accumulation and more effective protection from moving sand. Accordingly, embodiments of the sand fence are constructed in one or more long sections perpendicular to the prevailing wind direction, rather than being parallel to the facility being protected.

Such sand fence design, according to embodiments of the present invention, is flexible and can extend in kilometers distance to protect large facilities such as roads, industrial plants, etc. Further, such sand fence design allows flexible selection of support posts and tension wires to provide stabilities to hold the geogrid sand fence, beyond that of conventional fencing. Such sand fence design also allows the height to be easily extended to prolong the usefulness of the sand fence as sand accumulates around the fence. Thus, such sand fence design can advantageously facilitate the intercept of moving sand at a proper distance from a protected facility over an extended period of time, beyond that conventionally possible.

BRIEF DESCRIPTION OF DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

FIG. 5 is a side perspective view of the sand fence shown in FIG. 1 according to an embodiment of the present invention;

FIG. 6 is a partial top perspective view of the sand fence shown in FIG. 1 according to an embodiment of the present invention;

FIG. 7 is a perspective view of a support member for supporting the sand fence shown in FIG. 1 according to an embodiment of the present invention;

DETAILED DESCRIPTION OF INVENTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

As shown in FIGS. 1-12, embodiments of the present invention provide a sand fence including a High Density Polyethylene (HDPE) mesh sand fence material with specific material properties including, for example, material type, aperture opening size and geometry, porosity, and specific height. Such specific material properties and configuration properties including, for example, position with respect to the prevailing wind, are based on field studies performed by the assignee application to create an enhanced sand fence capable of maximizing sand intercept prior to the sand reaching a facility to be protected. As will be described in more detail below, the specific material qualities of the sand fence allows the sand fence to be constructed with only fence posts and wire supports, negating a need for extensive reinforcement, such as, for example, by chicken wire or slats to be constructed, and allows construction without a frame and without using slats.

Figure 1:
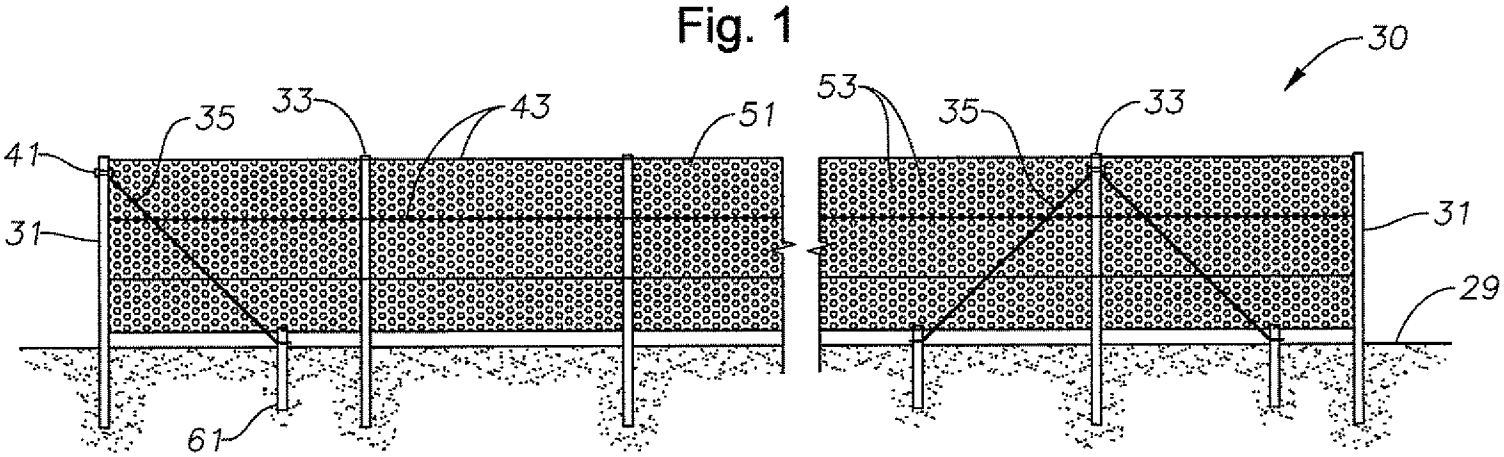
FIG. 1 is a front perspective view of a sand fence according to an embodiment of the present invention.

FIG. 1 illustrates an exemplary embodiment of a sand fence 30 installed on/in a sand surface 29, preferably stabilized with a soil stabilizer. The sand fence 30 can include a plurality of support members 31, 33, which can include for each continuous section of fence, two end support members 31 and at least one, but normally a plurality of intermediate support members 33. The end support members 31 and the intermediate support members 33 can be, for example, a metal pipe in the form of a pole, or other structure having similar structural qualities. In the exemplary configuration, each member 31, 33, is in the form of an iron pipe having a height of approximately 300 cm and a diameter of approximately 50 mm. Each support member 31, 33, can also include an assembly for connecting lateral support (guy) wires 35, which can include one or more 8 mm bolt receiving apertures 37, 39 (see, e.g. FIG. 7), located 10 cm and 20 cm down from the top portion of the members 31, 33, respectively, for receiving guy wire connecting bolts 41. Note, however, that any type of support member having sufficient strength could be utilized. According to the preferred configuration, the support members 31, 33, are spaced apart approximately 300 cm and are sunk approximately 90 cm into the surface 29.

The sand fence 30 can also include a plurality of galvanized tension wires 43 (e.g., four) extending between each adjacent pair of support members 31, 33, each configured either as a continuous length of wire between end members 31, which are secured to the intermediate support members 33 via, e.g., PVC coated, tightening wires; or as individual wire segments connecting between support members 31, 33, using the tightening wires or other fastening means known to those skilled in the art. According to the exemplary configuration, for support members 31, 33, for example, configured to extend 210 cm above the surface 29, the individual tension wires 43 can be located, for example, at approximately the 10 cm, 77 cm, 143 cm, and 210 cm locations along the support members 31, 33, above the surface 29. In either exemplary configuration, the tensioning wires 43 can be connected to the end members 31, for example, using various fasteners known to those skilled in the art (e.g., 8 mm bolts).

Figure 2:
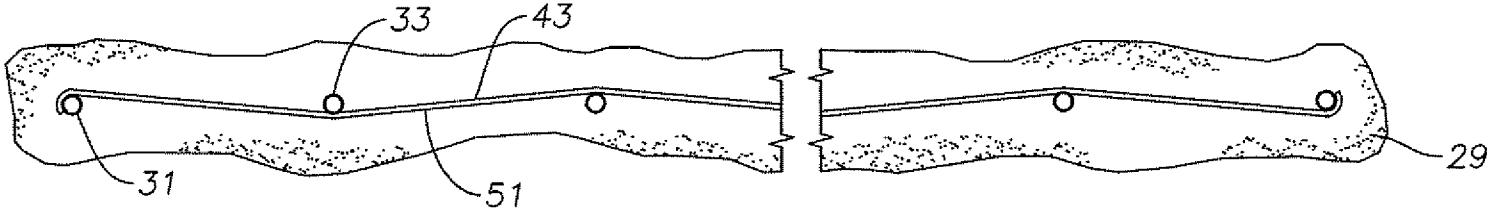
FIG. 2 is a partial top perspective view of the sand fence shown in FIG. 1 according to an embodiment of the present invention.

According to embodiment of the installation process, the individual tension wires 43 can alternatingly extend around opposite sides of each of the intermediate members 33 (see, e.g., FIG. 2). According to another embodiment of the installation process, the individual tension wires 43 are horizontally run through and connected to each of the intermediate support members 33, for example, using PVC coated tightening wires or other means known to those skilled in the art. According to another embodiment of the installation process, the tension wires 43 are connected on the either side of the intermediate support members 33 using a fastener connected to the members 33. In either exemplary configuration, the tension wires 43 are used to maintain the intermediate support members 33 in position and are used to guide and support a polymer fencing material 51. Various other configurations are, of course, within the scope of the present invention.

Figure 3:
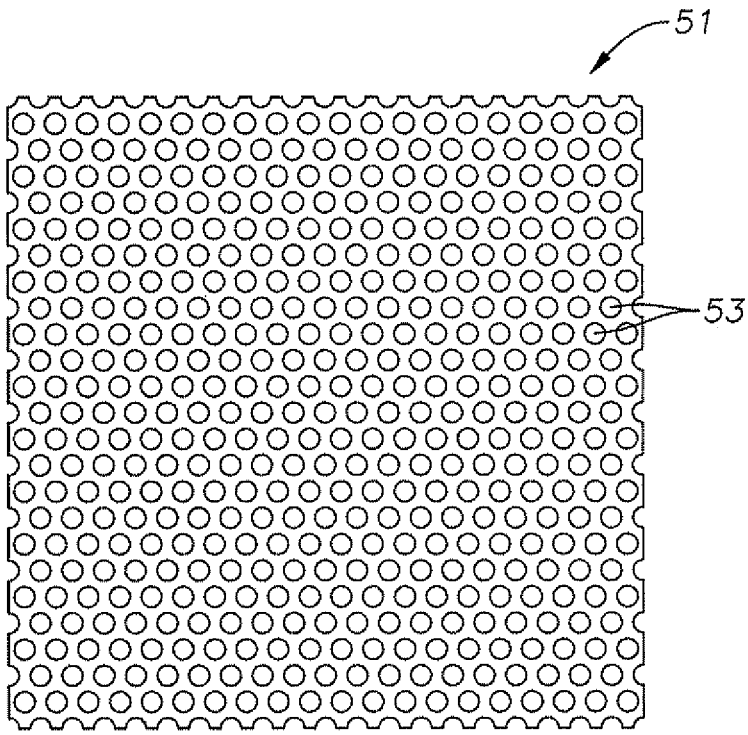
FIG. 3 is a perspective view of exemplary fencing material according to an embodiment of the present invention.
Figure 4:
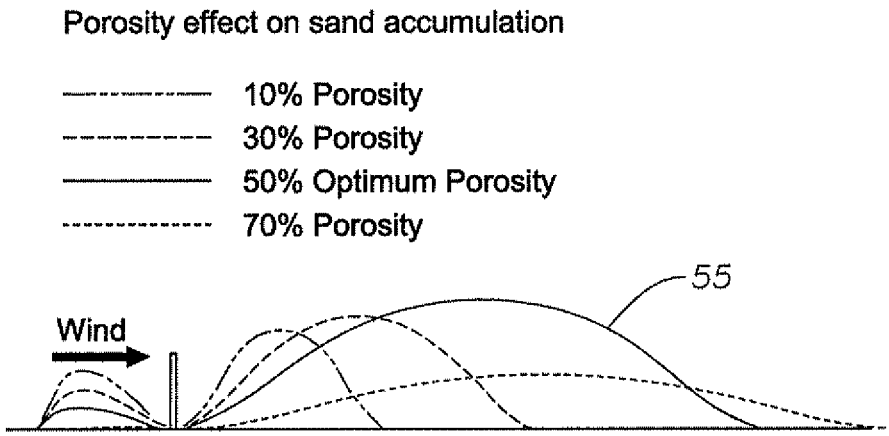
FIG. 4 is a comparative graph illustrating sand accumulation effectiveness according to various porosities of the fencing material according to embodiments of the present invention.

As perhaps best shown in FIG. 3, the sand fence 30 can also include the polymer fencing material 51 attached along the length of support members 31, 33. Accordingly, in the exemplary configuration, the polymer fencing material 51 is approximately 200 cm in vertical length and is supported by the support members 31, 33, and the tension wires 43. The fencing material 51 can have some degree of stretching employed during attachment to the support members 31, 33, and/or tension wires 43, in order to maintain the fencing material 51 vertical and straight, without any crimps therein.

As perhaps best shown in FIG. 1, the fencing material 51, in the exemplary embodiment of the present invention, extends upwardly, for example, from between approximately 10-20 cm above the surface 29 to the top of the support members 31, 33. The 10-20 cm gap between the lower portion of the fencing material 51 and the surface 29 beneficially can result in a reduced windward side buildup of sand immediately adjacent to windward side of the fence 30, and thus, can resulting provide in an increased operational life of the sand fence 30 before requiring an extension, described in more detail later.

In the most preferred embodiment of a sand fence 30, the fencing material 51 is a High Density Polyethylene ("HDPE") plastic mesh geogrid, for example, having 2% finely divided carbon black for enhanced ultraviolet resistance. HDPE products with proper UV stabilization have been determined by the inventors to be the best polymer products for the expected operational conditions because of its higher density, high impact resistance, and higher life span in such exposed conditions, as compared to other polymers in similar conditions.

As shown in FIG. 3, the fencing material 51 can include a plurality of circular apertures 53, for example, spaced uniformly throughout the fencing material 51, resulting in a porosity of preferably between 40% and 60%, and more preferably between 45% and 55%, and more preferably 50%, to thereby maximize sand deposit volume. Note, although various porosity percentages may be utilized, as desired, FIG. 4 (at 55) illustrates the benefit of utilization of the 50% porosity vs. the other porosity values, which were found in a related study to be substantially less effective. In particular, from the study, it was concluded that the 50% porosity, particularly when employing circular apertures 53, provided the most effective porosity to reduce the wind speed when it approaches the sand fence 30 and to cause the wind to drop a maximum load of sand on the leeward side of the sand fence 30. Also from the study, it was concluded that higher porosities resulted in a lesser effect on the wind speed, allowing more sand to pass the sand fence 30 without stopping. In contrast, lower porosities were found to result in a more sudden deceleration of wind velocity, which resulted in the wind currents dropping the sand load in front of the sand fence 30 (on the windward side), which results in shortening the life of the sand fence 30 (i.e., the sand fence will be more quickly buried). In the same study, the preferred diameter of the circular apertures 53 was found to be approximately 8 mm±2 mm. Note, although circular apertures 53 were found to provide enhanced performance, other aperture shapes, such as diamond, having other sizes, may be utilized, as desired, but were found to be less effective.

Still further, it was found that a structural weight of approximately 0.650 Kg/m2±0.025 Kg/m2 provides enhanced benefits. A relatively heavy weight provides a certain degree of stability to the fencing material 51, and thus, the sand fence 30. It also helps the fencing material 51 to resist the impact encountered due to movement/flying sand. It also beneficially helps increase the life of the fencing material 51, and thus, the sand fence 30, against the U.V. attack associated with the exposed conditions. Because U.V. attack is a surface phenomenon causing surface erosion of the polymer, surface erosion will take place, but due to such a heavy weight, according to the preferred configuration, it will take an extensive amount of time for the fencing material 51 to be eroded. The weight, however, should not be too high, otherwise such weight will tend to cause a problem in handling of roles of the fencing material 51. Excessive weight will also result in a need for heavier installation accessories, which will ultimately increase the cost of the sand fence installation, without adding any substantial additional benefit to the sand fence 30. Accordingly, a structural weight of approximately 0.650 Kg/m2±0.025 Kg/m2 was found to maximize such benefits while minimizing such limitations. It is expected that the fencing material 51 made according to such embodiment of the present invention, even in exposed conditions, will last for at least 15-20 years, which is a much higher period than the expected life of the sand fence 30, itself.

As shown in FIGS. 5 and 6, according to embodiment of the present invention, each end member 31 is supported by three separate, e.g., PVC coated, guy wires 35, each connected via stake posts 61 inserted into the surface 29, for example, approximately 200 cm from the respective end member 31, to thereby provide enhanced windward, leeward, and lateral stability. Each intermediate member 33 is supported by two separate, e.g., PVC coated guy wires 35, each also connected via stake posts 61 inserted into the surface 29, for example, approximately 200 cm from the respective intermediate member 33, to thereby provide enhanced windward and leeward stability. Further, surface 29 (and overlay surface 81, FIG. 9) is stabilized with a pre-specified soil stabilizer (not shown) based on a study of the soil composition to make the sand fence 30 more stable, according to the exemplary embodiment of the present invention.

As perhaps best shown in FIG. 7, each of the support members 31, 33, can include an extension connector such as, for example, flange 71 which can be used to connect additional lengths of support members 31, 33, to extend the height of the sand fence 30, such as when the height of either of the sand mounds/accumulations 73, 75 (see FIGS. 10 and 11) accumulate to a height approaching the height of the sand fence 30 (i.e., some value approaching 200 cm above the surface 29, such as, one-third or two-thirds meters from the top of the fencing material 51).

Figure 8:
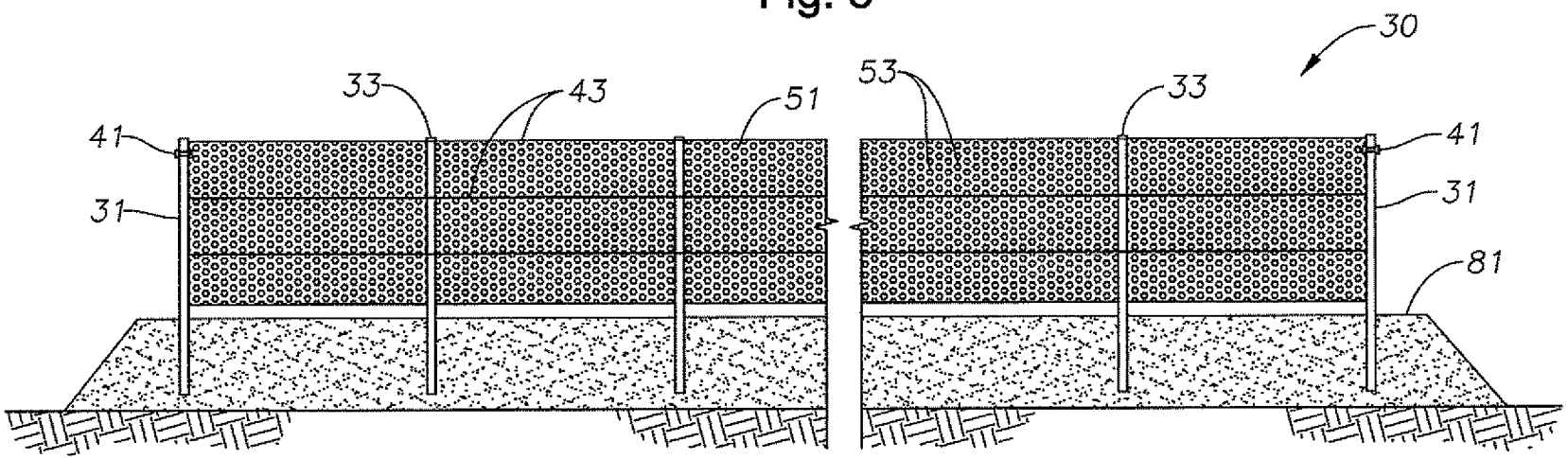
FIG. 8 is a front perspective view of a sand fence positioned upon an overlay layer according to an embodiment of the present invention.
Figure 9:
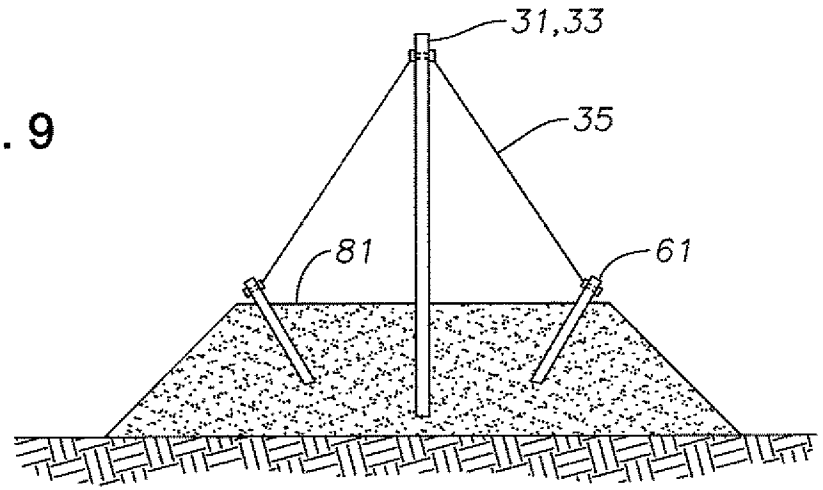
FIG. 9 is a side perspective view of the sand fence shown in FIG. 8 according to an embodiment of the present invention.

Although the sand fence 30 is primarily configured to be positioned in a sand environment, such sand environments sometimes include hard or rock surfaces. As shown in FIGS. 8 and 9, embodiments of the present invention include provisions for erecting the above described embodiments of a sand fence 30 on such hard or rock surfaces. For example, according to the illustrated embodiment of the sand fence 30, in preparation for installation of the sand fence 30, a sand or other relatively soft surface or berm (e.g., overlay surface 81) capable of receiving the members 31, 33, can be first overlaid upon the hard or rock surface (e.g., bedrock). The length of the overlay surface 81 can/should be at least approximately 1500 to 2000 cm beyond either end post member 31. The width of the overlay surface 81 can/should be approximately 300 to 400 cm, and the thickness of the overlay surface 81 can/should be approximately 100 to 120 cm. All other features of the sand fence 30 can generally remain the same as that described with respect to application to a sand surface 29, with possibly the exception that it may be preferable to insert the stake posts 61 at an acute angle of, for example, 45 degrees, rather than at a more normal orientation, particularly if the stake posts 61 are near or adjacent an edge of the overlay surface 81.

Figure 10:
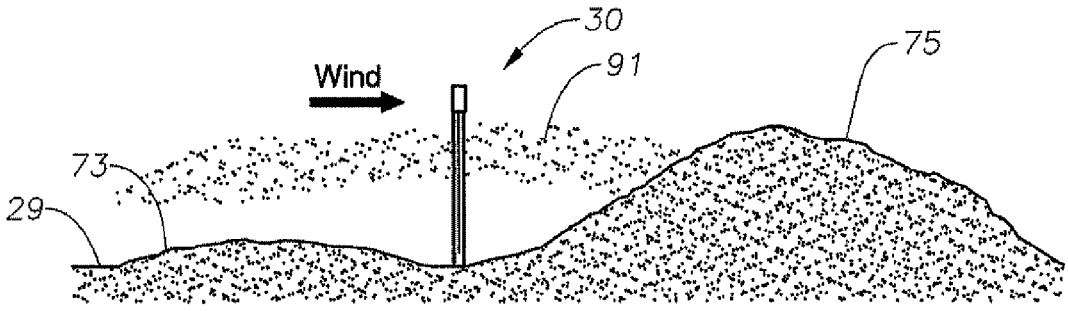
FIG. 10 is a schematic diagram illustrating sand particle accumulation according to an embodiment of the present invention.
Figure 11:
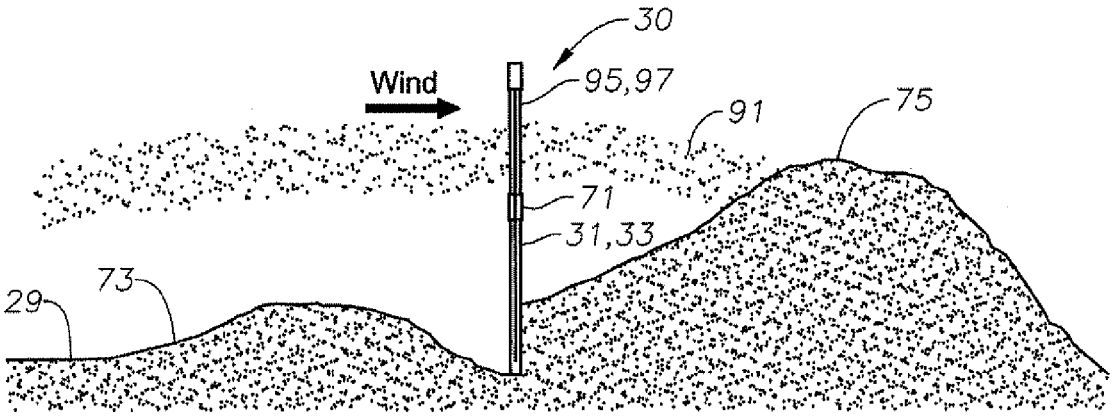
FIG. 11 is a schematic diagram illustrating application of extension members to the sand fence of FIG. 1 according to an embodiment of the present invention.
Figure 12:
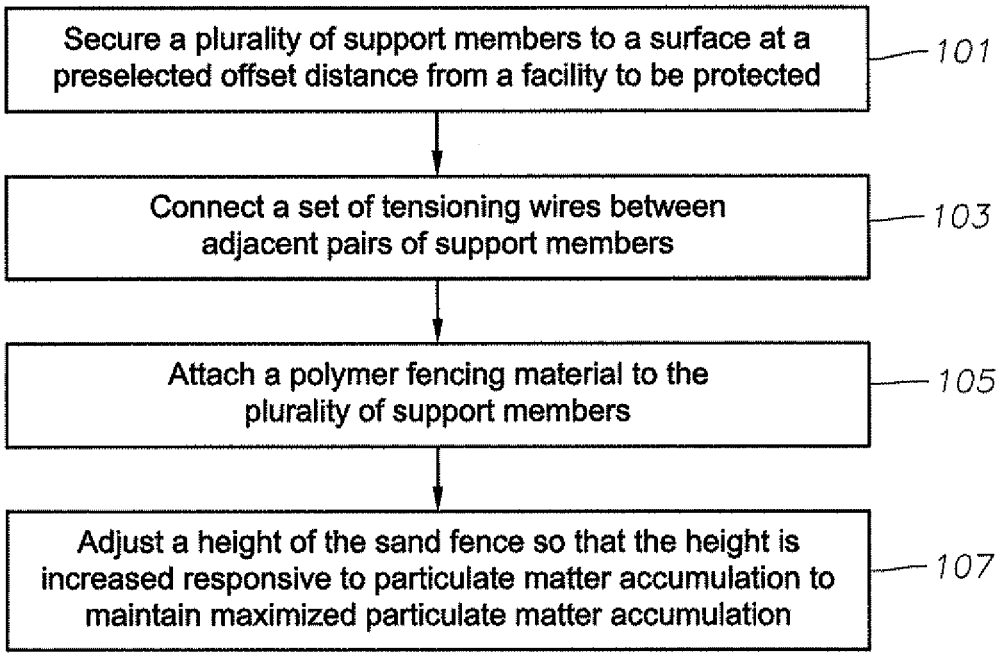
FIG. 12 is schematic flow diagram of a method of depositing matter moved by wind currents according to an embodiment of the present invention.

As perhaps best shown in FIG. 10, as the wind blows along surface 29, it carries sand particles 91. As the wind approaches the sand fence 30, the configuration of the fencing material 51 causes the wind to slow to a speed where the sand particles 91 are dropped and/or are no longer carried along by the wind. As such, the sand particles 91 accumulate around the sand fence 30. As the sand particles 91 continue to accumulate, the height of sand fence 30 can be adjusted to maintain sand control effectiveness (see FIG. 11). In the most preferred configuration, the initial fence height is 2 meters. In field tests, this height was shown to control 90% of the moving/blowing sand. Approximately 70% of sand is within 2 meters above ground, 20% of sand creeps or rolls across the surface, and 10% of sand is suspended. When the height of the sand mounds/accumulations 73, 75, reached a predetermined level, the height of the sand fence 30 can be adjusted in either one or two meter increments, as desired, to maintain the effectiveness of the sand fence 30.

Embodiments of the present invention also include methods for depositing matter moved by wind currents. For example, as perhaps best shown in FIG. 12, a method can include the steps of securing a plurality of support members 31, 33, to a surface 29, 81, at a preselected offset distance from a facility to be protected (block 101), connecting a set of at least three, but preferably four, tensioning wires 43 between adjacent pairs of support members 31, 33 (block 103), and attaching a polymer fencing material 51 to the plurality of support members 31, 33, and/or tensioning wires 43 to thereby form a sand fence 30 (block 105). The plurality of support members 31, 33, can include at least two end post members 31 and at least two, but preferably multiple, intermediate post members 33, spaced, for example, approximately 300 cm apart. The plurality of support members 31, 33, can be inserted to extend downward into the surface 29, 81, for example, 90 cm, and can be inserted to extend upwardly from the surface 29, 81, for example, 210 cm or so, for a fence using 200 cm fencing material 51. The support members 31, 33, can also be further supported with guy wires 35 secured with stake posts 61 inserted into the surface 29, 81, for example, 200 cm or so from the respective support member 31, 33. According to an embodiment of the method, the sand fence 30 is positioned substantially perpendicular to a prevailing direction of the wind currents, and at an offset distance of, for example, approximately 100 times the height of the fence material in meters from the facility to be protected, or 200 meters for a fence having a height of 200 cm, so that the particulate matter accumulation 75 does not substantially encroach upon the facility to be protected. Note, according to the preferred configuration, for the exemplary 200 cm sand fence, the 200 meter positioning should be adjusted so that the fence is positioned on the highest elevation of the original terrain within the approximately 200 meters.

According to an embodiment of the method, the polymer fencing material 51 has a height in a range of preferably between approximately 1.5 meters to 2.5 meters, and more preferably 2.0 meters, and can have a plurality of apertures 53 that result in a fencing material porosity in a range of between 40% to 60%, and more preferably between approximately 45% to 55%, and even more preferably approximately 50%, to reduce a speed of the wind currents as the wind currents move through the fencing material 51. Further, the apertures 53 are preferably substantially circular apertures with diameters in a range of between, for example, approximately 6 mm to 10 mm. Such combination of features has been found in a study to maximize the control of sand. Particularly, it has been found that such a sand fence 30 can control between approximately 80% and 90% of moving particulate matter moving responsive to the wind currents, maximizing particulate matter precipitation and accumulation 75 on a leeward side of the fence 30 prior to the wind currents reaching the facility to be protected.

Further, according to an embodiment of the method, the polymer fencing material 51 is attached to the support members 31, 33, so that the fencing material 51 is positioned above the surface 29, 81, in a range of between approximately 10 cm and 20 cm to prevent creeping sand or other matter not able to easily pass through the apertures 53 or continue movement therethrough, from collecting on the windward side of the sand fence 30. Further, in order to enhance the strength of the sand fence 30, particularly where wind currents can shift in opposite directions, the fencing material 51 can be horizontally positioned to alternate between opposite contact surfaces of adjacent intermediate post members 33 as illustrated in FIG. 2. Still further, according to an embodiment of the method, the fencing material 51 can be a High Density Polyethylene geogrid mesh having a structural weight in a range of between, for example, approximately 0.625 Kg/m2 to 0.675 Kg/m2. Such configuration, for example, allows the fence material 51 to be easily formed into roles having a height of approximately 2 meters and a length of approximately of 80 meters to 100 meters.

According to an embodiment of the present invention, the method can also include adjusting a height of the sand fence 30 so that the height is increased responsive to particulate matter accumulation 75 to thereby maintain maximized particulate matter accumulation (block 107). Such step is generally performed when the particulate matter (e.g., sand particles 91) accumulated on the leeward side of the sand fence 30, accumulates to a level of between approximately ⅓ to ⅔ meters from a top of the attached fencing material 51. The step of adjusting the height of the sand fence 30 can include the steps of connecting a separate one of a plurality of extension members 95, 97, to an extension connector 71 positioned at an upper end portion of each separate one of the plurality of support members 31, 33. As with the initial installation of the sand fence 30, the method can also include the step of connecting a set of at least three, but preferably four, tensioning wires 43 between adjacent pairs of extension members 95, 97, and attaching additional polymer fencing material 51 to the plurality of extension members 95, 97, and/or tension wires 43. The step of installing the additional fencing material 51 can include horizontally positioning the fencing material 51 to alternate between opposite contact surfaces of adjacent intermediate post extension members 97.

As a recap, according to the studies performed in the development of various embodiments of the present invention, including the exemplary configurations, described above, the 50% porosity, from aerodynamic point of view, was found to be the most effective porosity in slowing moving wind gently to drop the load of sand in the leeward side of the sand fence 30, and in minimizing turbulence which could cause lifting of sand particles 91 from a sand particle accumulation 75 formed on the leeward side of the sand fence 30. The circular configuration of the apertures 53 was found to provide the most appropriate geometry in slowing the wind speed gently, as opposed to abruptly, and to minimize turbulence which could cause lifting of sand particles 91 from a sand particle accumulation 75 formed on the leeward side of the sand fence 30. The 2-meter height of the sand fence 30 was found to be the most effective height to intercept 80-90% of the total sand particles 91, which comprises creeping and trajectory sand particles. Positioning of the sand fence 30 perpendicular to the prevailing wind currents was found to be the most effective orientation, in contrast to positioning the sand fence 30 parallel to the facility to be protected. Securing the sand fence 30 with post members 31, 33, and tension wires 43, along with guy wires 35 secured with stake posts 61, was found to not only protect the fence from scavengers or animals, but to provide a wind velocity capability substantially within all possible operational wind velocity conditions provided the fence material 51 is not cut or blocked by flying debris.

Benefits of the above described technology can include the application of standardized sand fence materials, design, and construction; and the minimization of safety hazards associated with moving sand such as, for example, road blockage, the covering of pipeline manifold valves, sand accumulations over pipelines that prevent access in case of an emergency. Benefits also include reduced budgeting for mechanical sand removal (currently the primary existing method in use), which tends to enhance sand movement and a need for continuous contractor maintenance. Benefits further include increased local manufacturer and contractor participation, particularly in arid regions, which may not provide ready access to wood and wood products.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

The invention claimed is:

1. A method for depositing sand moved by wind currents, the method comprising the steps of:

controlling between approximately 80% and 85% or more of moving sand particulate matter moved by the wind currents in a sand environment through employment of a single row sand fence positioned at an offset distance from a structure to be protected, the single row sand fence having a structural configuration designed to maximize particulate matter precipitation and accumulation on a leeward side of the sand fence prior to the wind currents reaching the structure to be protected, the step of controlling between approximately 80% and 85% or more of moving sand particulate matter moved by the wind currents in the sand environment, comprising:

determining the offset distance from the structure to be protected, securing a plurality of support members to a surface at the offset distance from the structure to be protected, the plurality of support members extending downward into the surface a first preselected distance and extending upwardly from the surface a second preselected distance, and attaching a polymer fencing material to the plurality of support members to thereby form a sand fence, the polymer fencing material having a height of approximately 2.0 meters and having a plurality of apertures having diameters in a range of between approximately 6 mm to 10 mm and distributed to provide a fencing material porosity of approximately 50% to thereby maximize the reduction in a speed of the wind currents as the wind currents move through the fencing material and maximize an amount of sand carried by the wind to be deposited on the leeward side of the sand fence prior to the wind currents reaching the structure to be protected.

2. A method as defined in claim 1, further comprising the step of:

adjusting a height of the fence in one or two meter increments so that the height is increased responsive to particulate matter accumulation to thereby maintain maximized particulate matter accumulation.

3. A method as defined in claim 1, wherein the plurality of support members include at least two end post members and at least two substantially spaced apart and intermediate post members;

wherein the polymer fencing material comprises a high density polyethylene geogrid mesh;

wherein the apertures are circular; and wherein the step of attaching the polymer fencing material to the plurality of support members includes the step of attaching the polymer fencing material so that the fencing material is positioned approximately 20 cm above the surface.

4. A method as defined in claim 1, wherein the polymer fencing material comprises a high density polyethylene geogrid mesh; and wherein the apertures are circular.

5. A method as defined in claim 1, wherein the plurality of support members include at least two end post members and at least two intermediate post members;

wherein the method further comprises the step of extending a set of four tensioning wires between each pair of adjacent intermediate post members;

wherein each of the plurality of support members are horizontally spaced approximately three meters apart from each other of the plurality of support members; and wherein the sand fence comprises one or more sections oriented perpendicular to a prevailing direction of the wind currents and not parallel to the structure.

6. A method as defined in claim 1, wherein the polymer fencing material comprises a high density polyethylene geogrid mesh;

wherein the apertures are circular; and wherein each of the plurality of circular apertures are substantially uniformly distributed so that each pair of vertically adjacent apertures is uniformly horizontally offset from each intervening pair of horizontally adjacent apertures to thereby form a vertically oriented diamond shaped pattern of circular apertures between the each pair of vertically adjacent apertures and the each intervening pair of horizontally adjacent apertures.

7. A method as defined in claim 1, further comprising the step of:

increasing the height of the sand fence responsive to a buildup of sand on either windward or leeward sides of the sand fence reaching a predetermined level to thereby maintain effectiveness of the sand fence, the step of increasing the height of the sand fence comprising:

connecting a separate one of a plurality of extension members to a flanged extension connector connected to an upper end portion of each separate one of the plurality of support members; and attaching additional polymer fencing material to the plurality of extension members.

8. A method as defined in claim 7, wherein the step of increasing the height of the sand fence further includes the step of connecting a set of at least two tensioning wires between adjacent pairs of extension members; and wherein the step of increasing the height of the sand fence is performed when the particulate matter accumulated on the leeward side of the sand fence accumulates to the predetermined level of between approximately ⅓ to ⅔ meters from a top of the polymer fencing material.

9. A method as defined in claim 1, further comprising the steps of:

positioning the sand fence perpendicular to a prevailing direction of the wind currents; and positioning the sand fence at the offset distance from the structure to be protected, the offset distance being approximately 100 times the height of the sand fence so that the particulate matter accumulation does not encroach upon the structure to be protected.

10. A method as defined in claim 1, further comprising the step of:

pre-installing a length of overlay surface upon a hard or rock surface prior to securing the plurality of support members, the overlay surface configured to extend at least approximately 1500 to 2000 cm beyond either end post member of the plurality of support members, a width of the overlay surface being approximately 300 to 400 cm, and a thickness of the overlay surface being approximately 100 to 120 cm.

11. A method as defined in claim 1, wherein the polymer fencing material comprises a high density polyethylene geogrid mesh; and wherein the high density polyethylene geogrid mesh is characterized by being manufactured in rolls having a height of approximately two meters and a length of approximately of 80 meters to 100 meters.

12. A method as defined in claim 11, wherein the polymer fencing material has a structural weight in a range of between approximately 0.625 $Kg/m^2$ to 0.675 $Kg/m^2$.

13. A method as defined in claim 12, wherein the polymer fencing material comprises approximately 2% finely divided carbon black.

14. A method for depositing sand moved by wind currents, the method comprising the steps of:

controlling between approximately 80% and 90% of moving sand moved by near-surface wind currents moving the sand over a preselected location of interest, the preselected location of interest being in a desert area, the controlling of the moving sand performed through direct application of a sand fence secured to an earthen surface at the preselected location of interest and configured to affect a majority of moving sand carried by the wind currents and to maximize particulate matter precipitation and accumulation on a leeward side of the sand fence prior to the wind currents reaching a structure to be protected, comprising:

determining an offset distance from the structure to be protected, securing a plurality of support members to a surface at the offset distance from the structure to be protected, the plurality of support members extending downward into the surface a first preselected distance and extending upwardly from the surface a second preselected distance, and attaching a high density polyethylene geogrid mesh fencing material to the plurality of support members to thereby form a sand fence, the high density polyethylene material having a height of approximately two meters and having a plurality of circular apertures having diameters of approximately 8 mm and distributed to provide a fencing material porosity of approximately 50% to form the sand fence to thereby maximize the reduction in speed of the wind currents as the wind currents move through the fencing material and maximize an amount of sand carried by the wind to be deposited on the leeward side of the sand fence prior to the wind currents reaching the structure to be protected, the attaching of the high density polyethylene geogrid mesh fencing material performed so that the high density polyethylene geogrid mesh fencing material is positioned above the surface, to reduce windward side buildup of sand immediately adjacent to a windward side of the sand fence.

15. A method as defined in claim 14, wherein the high density polyethylene geogrid mesh fencing material is positioned approximately 20 cm above the surface.

16. A method as defined in claim 15, wherein the fencing material has a structural weight in a range of between approximately 0.625 $Kg/m^2$ to 0.675 $Kg/m^2$ to thereby provide stiffness.

17. A method as defined in claim 15, wherein each of the plurality of apertures are uniformly distributed so that each pair of vertically adjacent apertures is uniformly horizontally offset from each intervening pair of horizontally adjacent apertures to thereby form a vertically oriented diamond shaped pattern of circular apertures between the each pair of vertically adjacent circular apertures and the each intervening pair of horizontally adjacent apertures.

* * * * *